US010303073B2

(12) United States Patent
Ogawa

(10) Patent No.: US 10,303,073 B2
(45) Date of Patent: May 28, 2019

(54) ELECTROSTATIC LATENT IMAGE DEVELOPING TONER

(71) Applicant: KYOCERA Document Solutions Inc., Osaka (JP)

(72) Inventor: Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/963,517

(22) Filed: Apr. 26, 2018

(65) Prior Publication Data

US 2018/0314177 A1 Nov. 1, 2018

(30) Foreign Application Priority Data

Apr. 27, 2017 (JP) ..... 2017-088403

(51) Int. Cl.
*G03G 9/087* (2006.01)
*G03G 9/093* (2006.01)

(52) U.S. Cl.
CPC ..... *G03G 9/09321* (2013.01); *G03G 9/09364* (2013.01)

(58) Field of Classification Search
CPC ..... G03G 9/08708; G03G 9/08704; G03G 9/08706; G03G 9/08782; G03G 9/08791; G03G 9/08797
See application file for complete search history.

(56) References Cited

U.S. PATENT DOCUMENTS

2017/0371259 A1* 12/2017 Hioki ..... G03G 9/0825

FOREIGN PATENT DOCUMENTS

JP 2009-133946 * 6/2009 ..... G03G 9/087
JP 2015-125404 A 7/2015

OTHER PUBLICATIONS

Translation of JP 2009-133946.*

* cited by examiner

*Primary Examiner* — Peter L Vajda
(74) *Attorney, Agent, or Firm* — Studebaker & Brackett PC

(57) ABSTRACT

An electrostatic latent image developing toner includes a plurality of toner particles each including a toner core and a shell layer. The toner core contains a releasing agent substituted by a carboxyl group. The shell layer covers the entirety of a surface of the toner core. The shell layer includes a unit substituted by a ring-unopened oxazoline group. An amount of the ring-unopened oxazoline group contained in 1 g of the toner as measured by gas chromatography-mass spectrometry is at least 500 μmol and no greater than 1,400 μmol. An amount of endothermic energy generated due to melting of the releasing agent contained in 1 mg of the toner as measured by differential scanning calorimetry is at least 80 mJ and no greater than 160 mJ.

11 Claims, 2 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2017-088403, filed on Apr. 27, 2017. The contents of this application are incorporated herein by reference in their entirety.

BACKGROUND

The present disclosure relates to an electrostatic latent image developing toner.

There is for example a known technique for producing a toner by causing aggregation of polyester resin particles in an aqueous medium.

SUMMARY

An electrostatic latent image developing toner according to the present disclosure includes a plurality of toner particles each including a core and a shell layer. The core contains a releasing agent substituted by a carboxyl group. The shell layer covers the entirety of a surface of the core. The shell layer includes a unit substituted by a ring-unopened oxazoline group. An amount of the ring-unopened oxazoline group contained in 1 g of the toner as measured by gas chromatography-mass spectrometry is at least 500 μmol and no greater than 1,400 μmol. An amount of endothermic energy generated due to melting of the releasing agent contained in 1 mg of the toner as measured by differential scanning calorimetry is at least 80 mJ and no greater than 160 mJ.

DETAILED DESCRIPTION

Figure 1:
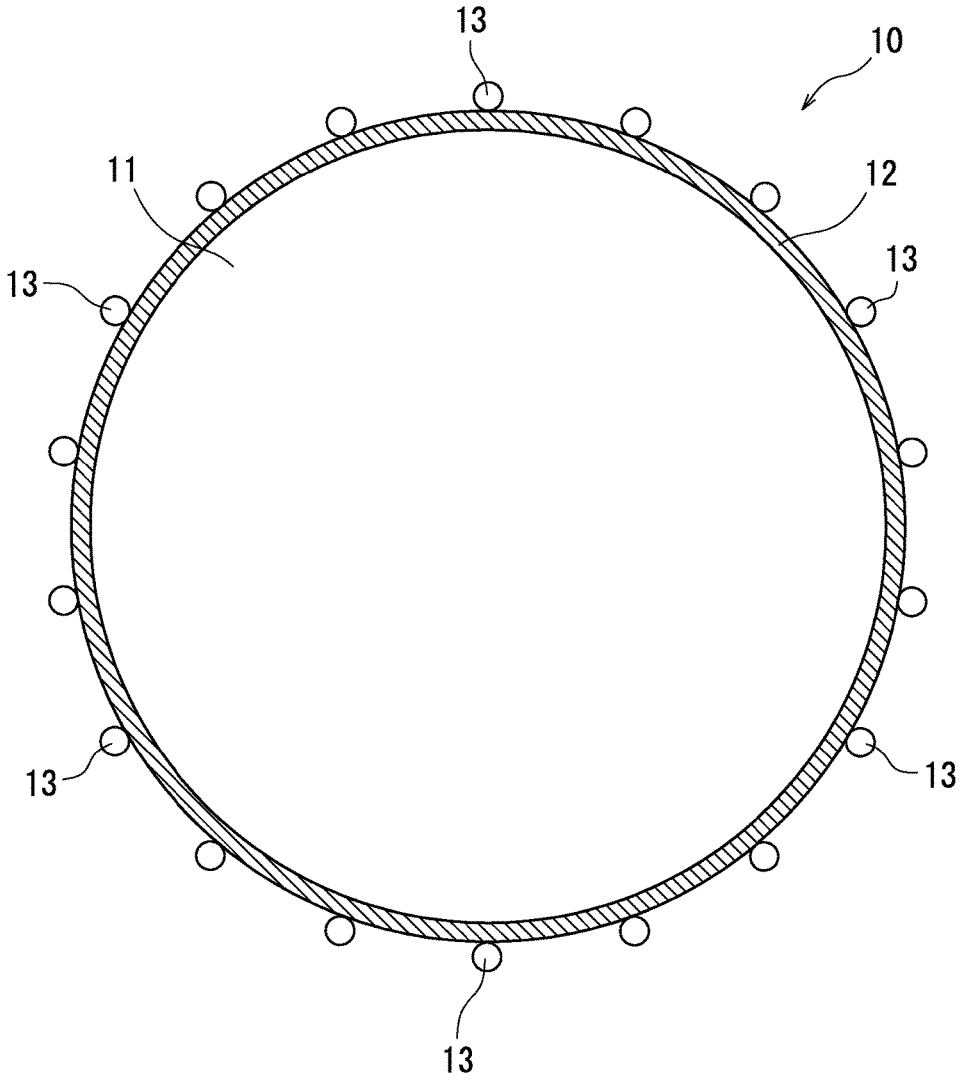
FIG. 1 is a diagram illustrating an example of a cross-sectional structure of a toner particle included in an electrostatic latent image developing toner according to an embodiment of the present disclosure.

The following describes an embodiment of the present disclosure in detail. Note that evaluation results (values indicating shape, physical properties, or the like) for a powder (specific examples include toner cores, toner mother particles, an external additive, and a toner) are each a number average of values measured for an appropriate number of particles of the powder, unless otherwise stated.

A number average particle diameter of a powder is a number average value of equivalent circle diameters of primary particles of the powder (Heywood diameters: diameters of circles having the same areas as projections of the particles) measured using a microscope, unless otherwise stated. A value for a volume median diameter ($D_{50}$) of a powder is a value measured based on Coulter principle (electrical sensing zone method) using "Coulter Counter Multisizer 4" manufactured by Beckman Coulter, Inc., unless otherwise stated. An acid value is a value measured in accordance with "Japanese Industrial Standard (HS) K0070-1992", unless otherwise stated.

Chargeability refers to chargeability in triboelectric charging, unless otherwise stated. A level of positive chargeability (or a level of negative chargeability) in triboelectric charging can be confirmed using a known triboelectric series or the like.

In the following description, the term "-based" is appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term encompassing both acryl and methacryl.

A toner according to the present embodiment can be favorably used for example as a positively chargeable toner for development of an electrostatic latent image. The toner according to the present embodiment is a powder including a plurality of toner particles (particles each having features described below). The toner may be used as a one-component developer. Alternatively, the toner may be mixed with a carrier using a mixer (for example, a ball mill) to prepare a two-component developer. An example of carriers suitable for image formation is a ferrite carrier (a powder of ferrite particles). In order to form high quality images for a long period of time, magnetic carrier particles each including a carrier core and a resin layer covering the carrier core are preferably used. In order for the carrier to have a sufficient property for charging the toner for a long period of time, it is preferable that the resin layer entirely covers a surface of the carrier core (that is, no surface region of the carrier core is exposed from the resin layer). In order that carrier particles are magnetic, carrier cores may be formed from a magnetic material (for example, a ferromagnetic material such as ferrite) or a resin in which magnetic particles are dispersed. Alternatively, magnetic particles may be dispersed in resin layers covering the carrier cores. The resin layers are for example formed from at least one resin selected from the group consisting of fluororesins (specific examples include PFA and FEP), polyamide-imide resins, silicone resins, urethane resins, epoxy resins, and phenolic resins. In order to form high quality images, the amount of the toner in the two-component developer is preferably at least 5 parts by mass and no greater than 15 parts by mass relative to 100 parts by mass of the carrier. The number average primary particle diameter of the carrier is preferably at least 20 μm and no greater than 120 μm. Note that a positively chargeable toner included in a two-component developer is positively charged by friction with a carrier.

The toner according to the present embodiment can for example be used for image formation in an electrophotographic apparatus (an image forming apparatus). The following describes an example of image forming methods using an electrophotographic apparatus, First, an image forming section (for example, a charger and a light exposure device) of the electrophotographic apparatus forms an electrostatic latent image on a photosensitive member (for example, on a surface of a photosensitive drum) based on image data. Then, a developing device (specifically, a developing device loaded with developer including toner) of the electrophotographic apparatus supplies the toner to the photosensitive member to develop the electrostatic latent image formed on the photosensitive member. The toner is charged by friction with a carrier, a development sleeve, or a blade in the developing device before being supplied to the photosensitive member. A positively chargeable toner is charged positively. In a development process, the toner (specifically, the charged toner) on the development sleeve (for example, a surface of a development roller in the developing device) disposed in the vicinity of the photosensitive member is supplied to the photosensitive member and attached to a part of the electrostatic latent image exposed to light on the photosensitive member, whereby a toner image is formed on the photosensitive member. The developing device is replenished with toner in an amount corresponding to that consumed in the development process from a toner container accommodating the toner for replenishment use.

In a subsequent transfer process, a transfer device of the electrophotographic apparatus transfers the toner image on the photosensitive member to an intermediate transfer member (for example, a transfer belt) and then further transfers the toner image on the intermediate transfer member to a recording medium (for example, paper). Thereafter, a fixing device (fixing method: nip fixing using a heating roller and a pressure roller) of the electrophotographic apparatus fixes the toner to the recording medium through application of heat and pressure to the toner. As a result, an image is formed on the recording medium. For example, a full-color image can be formed by superimposing toner images in four colors of black, yellow, magenta, and cyan. After the transfer process, toner remaining on the photosensitive member is removed by a cleaning member (for example, a cleaning blade). Note that a direct transfer process in which a toner image is directly transferred from the photosensitive member to the recording medium not via the intermediate transfer member may be employed. Also, a belt fixing method may be employed as the fixing method.

The toner according to the present embodiment is an electrostatic latent image developing toner having the following features (hereinafter referred to as basic features).

(Basic Features of Toner)

The electrostatic latent image developing toner includes a plurality of toner particles each including a core (hereinafter referred to as a "toner core")and a shell layer. The toner core contains a releasing agent substituted by a carboxyl group. The shell layer covers the entirety of a surface of the toner core. The shell layer includes a unit substituted by a ring-unopened oxazoline group. An amount of the ring-unopened oxazoline group contained in 1 g of the toner as measured by gas chromatography-mass spectrometry (hereinafter may be referred to as a "ring-unopened oxazoline group content") is at least 500 μmol and no greater than 1,400 μmol. An amount of endothermic energy generated due to melting of the releasing agent contained in I mg of the toner as measured by differential scanning calorimetry (hereinafter may be referred to as "ΔH") is at least 80 mJ and no greater than 160 mJ. The gas chromatography-mass spectrometry and the differential scanning calorimetry are the same as those described later in EXAMPLES or alternative methods thereof.

FIG. 1 illustrates an example of toner particles included in the toner having the above-described basic features. FIG. 1 illustrates a cross-sectional structure of a toner particle 10 included in the toner.

The toner particle 10 illustrated in FIG. 1 includes a toner mother particle and an external additive (a plurality of external additive particles 13). The external additive is attached to a surface of the toner mother particle. The toner mother particle includes a toner core 11 and a shell layer 12 disposed on a surface of the toner core 11. The shell layer 12 is substantially formed from a resin. The shell layer 12 covers the entirety of the surface of the toner core 11. The external additive includes as the external additive particles 13 at least one type of particles selected for example from the group consisting of silica particles, titanium oxide particles, and resin particles.

Figure 2:
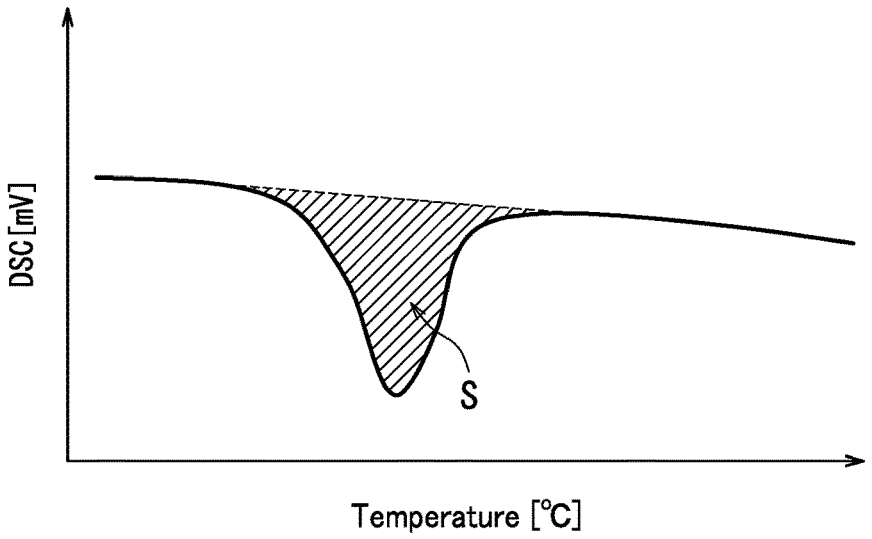
FIG. 2 is a graph showing a differential scanning calorimetry spectrum of the electrostatic latent image developing toner according to the embodiment of the present disclosure.

FIG. 2 is a graph showing DSC data of an example of the toner having the above-described basic features as measured in the second temperature increase using a differential scanning calorimeter. A heating rate and a cooling rate were both 10° C./minute. The graph in FIG. 2 shows a heat absorption curve (vertical axis: heat flow (DSC signal), horizontal axis: temperature).

In FIG. 2, ΔH (specifically, an amount of endothermic energy generated due to melting of the releasing agent contained in 1 mg of the toner) can be determined from an area S of a heat absorption peak unique to the releasing agent contained in 1 mg of the toner (specifically, a heat absorption peak due to melting of the releasing agent).

In order that the toner has both heat-resistant preservability and low-temperature fixability, the toner preferably exhibits sharp meltability. For example, it is preferable that the toner has a storage elastic modulus of $1.0\times10^8$ Pa at a temperature equal to or higher than 70° C. and a storage elastic modulus of $1.0\times10^5$ Pa at a temperature equal to or lower than 85° C. A toner having such characteristics has a sufficiently high storage elastic modulus at a temperature equal to or lower than 70° C. However, the storage elastic modulus of the toner sharply decreases when the toner is heated during fixing and becomes sufficiently small when the temperature of the toner reaches 85° C. A toner that exhibits sharp meltability as above tends to be excellent in both heat-resistant preservability and low-temperature fixability. In a preferable example of the toner, the toner has the storage elastic modulus of $1.0\times10^8$ Pa at a temperature of at least 70° C. and no higher than 75° C. and the storage elastic modulus of $1.0\times10^5$ Pa at a temperature of at least 80° C. and no higher than 85° C. In order that the toner exhibits sharp meltability as above, the toner preferably has a glass transition point of at least 65° C. and no higher than 70° C.

Figure 3:
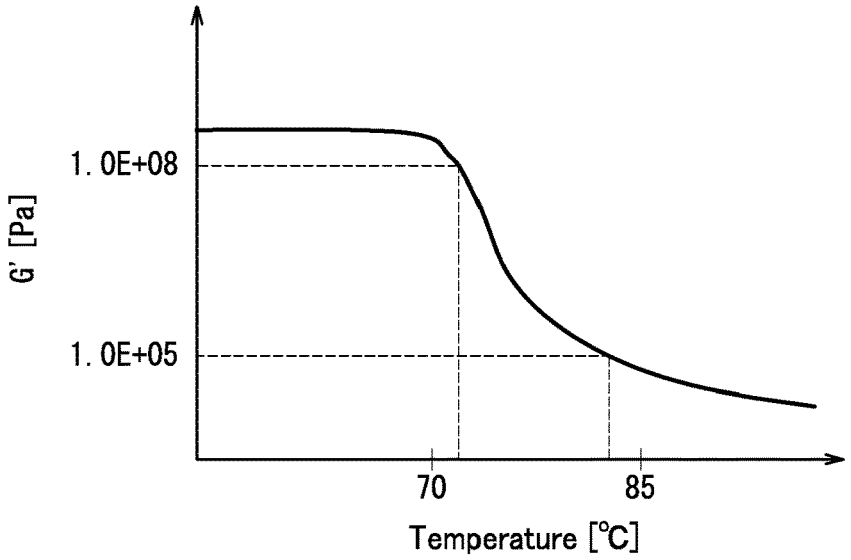
FIG. 3 is a graph showing a G' temperature dependence curve of the electrostatic latent image developing toner according to the embodiment of the present disclosure.

FIG. 3 illustrates an example of a G' temperature dependence curve (vertical axis: storage elastic modulus, horizontal axis: temperature) of the toner that exhibits sharp meltability as above. Specifically, FIG. 3 shows a result of measurement of the storage elastic modulus of the toner at respective temperatures carried out using a rheometer by increasing the temperature of the toner at a constant rate (heating rate: 4° C./minute). In the G' temperature dependence curve indicated in FIG. 3, the storage elastic modulus decreases as the temperature of the toner increases. As indicated in FIG. 3, the toner has a storage elastic modulus of $1.0\times10^8$ Pa at a temperature equal to or higher than 70° C. and a storage elastic modulus of $1.0\times10^5$ Pa at a temperature equal to or lower than 85° C.

In the above-described basic features, ΔH of the toner (specifically, an amount of endothermic energy generated due to melting of the releasing agent contained in 1 mg of the toner) is at least 80 mJ and no greater than 160 mJ. The larger ΔH of the toner is, the larger the amount of the releasing agent contained in the toner tends to be. In a typical toner, a large proportion (for example, approximately 90% by mass) of a toner particle is constituted by a binder resin and the rest (for example, approximately 10% by mass) of the toner particle is constituted h internal additives (for example, 5% by mass of a releasing agent and 5% by mass of a colorant). The amount of the releasing agent contained in the toner having the above-described basic features is 10 to 20 times larger than that of the releasing agent contained in the typical toner. As a result of the toner containing such a large amount of the releasing agent, the toner exhibits sharp meltability. However, in a configuration in which a large amount of the releasing agent is contained in the toner particles, the releasing agent tends to be detached from the toner particles. Also, surfaces of the toner particles tend to be highly adhesive by an influence of the releasing agent. As a result of the high adhesiveness of the surfaces of the toner particles, the toner tends to adhere to a member (specific examples include a carrier, the photosensitive drum, and the development roller) located within the image forming apparatus. Such adhesion of the toner causes an image defect. Also, in a configuration in which the amount of the releasing agent contained in the toner particles is excessively large, the toner particles become excessively liable to melting.

The present inventor considered inhibiting the above-described detachment of the releasing agent and the above-described adhesion of the toner by covering with the shell layer the entirety of the surface of the toner core containing a large amount of the releasing agent. However, it was not easy to secure the shell layer with sufficient bonding strength to the toner core containing a large amount of the releasing agent.

Focusing on the fact that a chemical bond (a covalent bond) can be formed between the toner core and the shell layer in a configuration in which the toner core contains a releasing agent substituted by a carboxyl group and the shell layer includes a unit substituted by a ring-unopened oxazoline group, the present inventor succeeded in covering with the shell layer the entirety of the surface of the toner core containing a large amount of the releasing agent. By covering the entirety of the surface of the toner core with the shell layer, the present inventor succeeded in inhibiting both the above-described detachment of the releasing agent and the above-described adhesion of the toner. The presence of the shell layer prevents the releasing agent from being exposed at the surface of the toner mother particle.

In the toner having the above-described basic features, it is preferable that the toner core contains a releasing agent substituted by a carboxyl group and the shell layer includes a unit represented by formula (A) shown below, for example. The unit represented by the following formula (A) is a unit substituted by a ring-unopened oxazoline group. In the following description, the unit represented by the following formula (A) will be referred to as a "unit (A)". It is possible to make the shell layer including the unit (A) further include a unit represented by formula (B) shown below by causing oxazoline groups in some of a plurality of units (A) included in the shell layer to react with the carboxyl group of the releasing agent contained in the toner core. In the following description, the unit represented by the following formula (B) will be referred to as a "unit (B)".

(A)

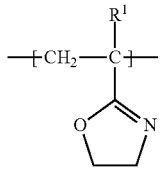

In formula (A), $R^1$ represents a hydrogen atom or an alkyl group optionally substituted by a substituent. When $R^1$ represents an alkyl group substituted by a substituent, the substituent is for example a phenyl group. $R^1$ particularly preferably represents a hydrogen atom, a methyl group, an ethyl group, or an isopropyl group.

(B)

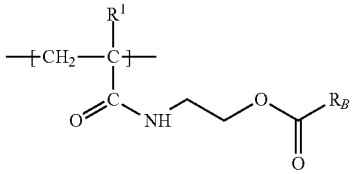

In formula (B), $R^1$ represents the same as $R^1$ in formula (A) and $R_B$ represents the releasing agent contained in the toner core.

The unit (A) is substituted by the ring-unopened oxazoline group. The ring-unopened oxazoline group has a cyclic structure and strong positive chargeability. The ring-unopened oxazoline group readily reacts with a carboxyl group, an aromatic sulfanyl group, and an aromatic hydroxyl group. For example, when the unit (A) included in the shell layer reacts with the carboxyl group of the releasing agent (represented by $R_B$ in formula (B)) contained in the toner core, the oxazoline group is ring-opened as shown in formula (B) to form an amide ester bond. As a result of formation of a strong bond (specifically, the amide ester bond) between the toner core and the shell layer, detachment of the shell layer from the toner core is inhibited. Note that the oxazoline group loses positive chargeability when ring-opened.

In the above-described basic features, the ring-unopened oxazoline group content (specifically, an amount of the ring-unopened oxazoline group contained in 1 g of the toner) is at least 500 μmol and no greater than 1,400 μmol. The larger the ring-unopened oxazoline group content is, more readily the strong bond specifically, the amide ester bond) is formed between the toner core and the shell layer. However, in a configuration in which the ring-unopened oxazoline group content of the toner is excessively large, positive chargeability of the toner tends to be excessively high. In the toner having the above-described basic features, the ring-unopened oxazoline group content of the toner is appropriate, and therefore, appropriate positive chargeability of the toner can be achieved while the entirety of the surface of the toner core can be covered with the shell layer. The shell layer can be secured to the surface of the toner core containing a large amount of the releasing agent with sufficient bonding strength through the above-described chemical bond.

Oxazoline groups in some of a plurality of units (A) included in the shell layer may be ring-opened using a carboxylic acid (for example, an acetic acid) as a ring opening agent. The ring-unopened oxazoline group content can be adjusted through use of the ring opening agent. It is possible to make the shell layer including the units (A) and (B) further include a unit represented by formula (C) shown below through use of the ring opening agent. In the following description, the unit represented by the following formula (C) will be referred to as a "unit (C)".

(C)

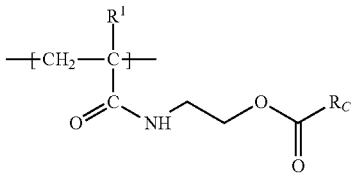

In formula (C), $R^1$ represents the same as $R^1$ in formula (A) and $R_C$ represents an alkyl group optionally substituted by a substituent. $R_C$ preferably represents a straight chain alkyl group having a carbon number of at least 1 and no greater than 6, and particularly preferably represents a methyl group or an ethyl group. When the acetic acid is used as the ring opening agent for the oxazoline group. $R_C$ represents a methyl group.

In the toner having the above-described basic features, the toner core contains a large amount of the releasing agent. Therefore, even in a configuration in which the toner core does not contain a binder resin, the toner can be suitably used for image formation. Alternatively, the binder resin may be contained in the toner core for the purpose of improving adhesion between the toner core and the shell layer or heat-resistant preservability of the toner. The binder resin is preferably a polymer of monomers (resin raw materials) including a styrene-based monomer, a (meth) acrylic acid alkyl ester, and a (meth)acrylic acid. Through use of such a polymer (the binder resin), it is possible to make a sufficient amount of the carboxyl group present in the toner core while ensuring sufficient fixability of the toner. Examples of the styrene-based monomer include styrene, alkylstyrenes (specific examples include α-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene). Examples of the (meth) acrylic acid alkyl ester include methyl (meth)acrylate, ethyl (meth)acrylate, n-propyl (meth)acrylate, iso-propyl (meth) acrylate, n-butyl (meth)acrylate, iso-butyl (meth)acrylate, and 2-ethylhexyl (meth)acrylate. The (meth)acrylic acid is an acrylic acid or a methacrylic acid.

In a configuration in which the toner core contains the above-described polymer (the binder resin), a unit represented by formula (D) shown below can be further included in the shell layer containing the units (A) and (B). The shell layer may further include the above-described unit (C). In the following description, the unit represented by the following formula (D) will be referred to as a "unit (D)".

(D)

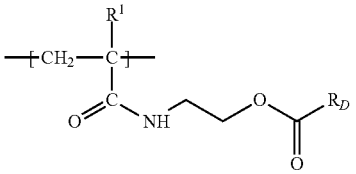

In formula (D), $R^1$ represents the same as $R^1$ in formula (A) and $R_D$ represents the polymer (the binder resin) contained in the toner core When the unit (A) included in the shell layer reacts with a carboxyl group of the binder resin contained in the toner core (represented by $R_D$ in formula (D)), the oxazoline group is ring-opened as shown in formula (D) to form an amide ester bond. As a result of formation of a strong bond (specifically, the amide ester bond) between the toner core and the shell layer, detachment of the shell layer from the toner core is inhibited.

The unit (A) can be introduced into the shell layer through polymerization of a compound represented by formula (I) shown below. Specifically, the unit (A) is a repeating unit that forms a main chain of the shell layer. In the following description, the compound represented by formula (1) will be referred to as a "compound (1)".

(1)

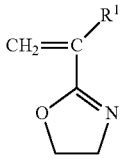

In formula (1), $R^1$ represents a hydrogen atom or an alkyl group optionally substituted by a substituent. When $R^1$ represents an alkyl group substituted by a substituent, the substituent is for example a phenyl group. $R^1$ particularly preferably represents a hydrogen atom, a methyl group, an ethyl group, or an isopropyl group.

A vinyl compound can be formed into a polymer resin) by addition polymerization ("C═C"→"—C—C—") through carbon-to-carbon double bonds "C═C". In the polymer of the vinyl compound, a unit derived from the vinyl compound is thought to be addition polymerized through carbon-to-carbon double bonds "C═C". The vinyl compound is a compound having a vinyl group ($CH_2$═CH—) or a substituted vinyl group in which a hydrogen atom is replaced. Examples of the vinyl compound include ethylene, propylene, butadiene, vinyl chloride, acrylic acid, acrylic acid ester, methacrylic acid, methacrylic acid ester, acrylonitrile, and styrene.

In order that the toner has the above-described basic features, the toner core preferably contains the releasing agent in an amount of at least 60% by mass and no greater than 95% by mass. For example, when the mass of the toner cores is 100 g, the mass of the releasing agent contained in the toner cores is preferably at least 60 g and no greater than 95 g. In a first preferable example of the toner having the above-described basic features, the toner core contains a colorant and does not contain a binder resin. In a configuration in which the toner core contains no binder resin, the toner core preferably contains the releasing agent in an amount of at least 85% by mass and no greater than 95% by mass. In a second preferable example of the toner having the above-described basic features, the toner core contains a colorant and further contains a binder resin in an amount of no greater than 15% by mass. The toner core for example contains the releasing agent in an amount of at least 60% by mass and smaller than 85% by mass and the binder resin in an amount of at least 1% by mass and no greater than 15% by mass.

Toner cores are typically categorized into pulverized cores (also called pulverized toner) and polymerized cores (also called chemical toner). Toner cores obtained by a pulverization method belong to the pulverized cores and toner cores obtained by an aggregation method belong to the polymerized cores. The toner cores of the toner having the above-described basic features are preferably polymerized cores. The releasing agent substituted by a carboxyl group and contained in the toner cores is preferably an ester wax. In order to ensure sufficient low-temperature fixability of the toner, it is preferable that the toner cores have no oxazoline group. Also, in terms of productivity of the toner, it is preferable that the toner cores contain no crystalline polyester resin. Even in a configuration in which the toner cores contain no crystalline polyester resin, the toner having the above-described basic features can exhibit sharp meltability as a result of a large amount of the releasing agent being contained in the toner cores.

In order that the toner is suitable for image formation, the shell layer preferably has a thickness of at least 50 nm and no greater than 400 nm. The thickness of the shell layer can be measured through analysis of a cross-sectional transmission electron microscope (TEM) image of the toner particles using commercially available image analysis software (for example, "WinROOF" manufactured by Mitani Corporation). In a situation in which the shell layer of a toner particle does not have a uniform thickness, thicknesses of the shell layer are measured at equally spaced four positions (specifically, four positions of intersection between the shell layer and two straight lines perpendicularly crossing each other at substantially the center of a cross section of the toner particle) and an arithmetic mean of the thus obtained four measurement values is determined to be an evaluation value (thickness of the shell layer) for the toner particle. A boundary between the toner core and the shell layer can be determined for example by selectively dying the shell layer only out of the toner core and the shell layer. In a situation in which a boundary between a toner core and a shell layer in the TEM image is not clear, the boundary can be made clear through mapping of distinctive elements included in the shell layer in the TEM image using a combination of transmission electron microscopy (TEM) and electron energy loss spectroscopy (EELS).

In order that the toner is suitable for image formation, the toner preferably has a volume median diameter ($D_{50}$) of at least 4 μm and no greater than 9 μm.

The following describes a method for producing the toner. In the following description, a material used for forming the shell layers will be referred to as a shell material.

A preferable example of methods for forming the toner cores is an aggregation method. In an example of the aggregation method, a releasing agent and a colorant each in the form of fine particles are initially caused to aggregate in an aqueous medium until particles of a desired diameter are obtained. Through the above, aggregated particles containing the releasing agent and the colorant are formed. Subsequently, the obtained aggregated particles are heated to cause coalescence of components of the aggregated particles. As a result, toner cores having a desired particle diameter are obtained.

Examples of methods for forming the shell layers include in-situ polymerization, in-liquid curing film coating, and coacervation. More specifically, in a preferred method for forming the shell layers on surfaces of the toner cores (a first shell layer formation method), toner cores are added into an aqueous medium in which a water-soluble shell material has been dissolved, and thereafter the aqueous medium is heated to cause a polymerization reaction of the shell material to proceed.

In the formation of the shell layers, resin particles (for example, a resin dispersion) may be used as a shell material. More specifically, in another preferable method for forming the shell layers on the surfaces of the toner cores (a second shell layer formation method), the resin particles are attached to the surfaces of toner cores in a liquid (for example, an aqueous medium) containing the resin particles and the toner cores, and thereafter the liquid is heated to cause formation of films from the resin particles to proceed. Bonding between the resin particles (consequently, a cross-linking reaction in each resin particle) can be caused to proceed on the surface of each toner core while the liquid is kept at a high temperature.

The aqueous medium is a medium containing water as a major component (specific examples include pure water and a liquid mixture of water and a polar medium). Examples of the polar medium contained in the aqueous medium include alcohols (specific examples include methanol and ethanol). The aqueous medium has a boiling point of approximately 100° C.

The shell layers may be formed on the surfaces of the toner cores in a liquid containing either or both a basic substance (specific examples include ammonia and sodium hydroxide) and a ring-opening agent (specific examples include an acetic acid). In a situation in which a shell material having an oxazoline group is used, the amount of the ring-unopened oxazoline group contained in the resultant shell layers can be adjusted by changing the respective amounts of the basic substance and the ring-opening agent. The larger the amount of the basic substance in the liquid is, the larger the amount of the ring-unopened oxazoline group tends to be. It is thought that a ring-opening reaction of the oxazoline group (a nucleophilic addition reaction with respect to a carbonyl group) is inhibited as a result of a carboxylic acid being neutralized (trapped) by the basic substance. By contrast, the ring-opening agent promotes the ring-opening reaction of the oxazoline group. Therefore, the larger the amount of the ring-opening agent in the liquid is, the smaller the amount of the ring-unopened oxazoline group tends to be.

The following describes the toner core, the shell layer, and an external additive in order. Nonessential components may be omitted according to intended use of the toner.

[Toner Core]

(Binder Resin)

The toner core may contain a binder resin. In order to increase bondability (reactivity) between the toner core and the shell layer, the binder resin preferably has an acid value of at least 10 mgKOH/g.

Examples of the binder resin include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Copolymers of the above-listed resins, that is, copolymers each formed by introduction of a repeating unit into any of the above-listed resins (specific examples include styrene-acrylic acid-based resins and styrene-butadiene-based resins) may also be used as the binder resin.

(Colorant)

The toner core may contain a colorant. A known pigment or dye that matches the color of the toner can be used as the colorant. In order that the toner is suitable for image formation, the amount of the colorant is preferably at least 1% by mass and no greater than 20% by mass relative to a mass of the toner cores.

The toner core may contain a black colorant. Carbon black is an example of the black colorant. Alternatively, the black colorant may be a colorant adjusted to a black color using a yellow colorant, a magenta colorant, and a cyan colorant.

The toner core may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15. 15:1, 15:2, 15:3, 15:4. 60, 62, and 66), Phthalocyanine Blue. C.I. Vat Blue, and C.I. Acid Blue.

(Releasing Agent)

The toner core of the toner having the above-described basic features contains the releasing agent substituted by a carboxyl group. The releasing agent substituted by a carboxyl group is preferably a wax. Examples of the wax include ester wax, polyethylene wax, polypropylene wax, fluororesin wax, Fischer-Tropsch wax, paraffin wax, and montan wax. One releasing agent may be used alone or two or more releasing agents may be used in combination.

The releasing agent substituted by a carboxyl group is preferably an ester wax (specific examples include synthetic ester wax and natural ester wax), and more preferably a synthetic ester wax. The melting point of the releasing agent can be easily adjusted within a desired range in a configuration in which a synthetic ester wax is used as the releasing agent. A synthetic ester wax can be synthesized for example by a reaction between an alcohol and a carboxylic acid (or a carboxylic acid halide) in the presence of an acid catalyst. A natural product derived from a natural substance such as a long-chain fatly acid prepared from a natural oil may for example be used as a raw material of the synthetic ester wax, or a commercially available synthetic substance may be used as a raw material of the synthetic ester wax. Examples of natural ester waxes that can be preferably used include carnauba wax and rice wax. In order to ensure presence of a sufficient amount of the carboxyl group, the releasing agent preferably has an acid value of at least 1.0 mgKOH/g. The releasing agent substituted by a carboxyl group particularly preferably has an acid value of at least 1.0 mgKOH/g and no greater than 10 mgKOH/g.

(Charge Control Agent)

The toner core may contain a charge control agent. The charge control agent is used for example in order to improve charge stability or a charge rise characteristic of the toner. The charge rise characteristic of the toner is an indicator as to whether or not the toner can be charged to a specific charge level in a short period of time.

Anionic strength of the toner core can be increased through inclusion of a negatively chargeable charge control agent (specific examples include organic metal complexes and chelate compounds) in the toner core. Cationic strength of the toner core can be increased through inclusion of a positively chargeable charge control agent (specific examples include pyridine, nigrosine, and quaternary ammonium salt) in the toner core. However, inclusion of a charge control agent in the toner core is not necessary so long as the toner has sufficient chargeability.

(Magnetic Powder)

The toner core may contain a magnetic powder. Examples of materials of the magnetic powder that can be preferably used include ferromagnetic metals (specific examples include iron, cobalt, nickel, and alloys thereof), ferromagnetic metal oxides (specific examples include ferrite, magnetite, and chromium dioxide), and materials subjected to ferromagnetization (specific examples include carbon materials to which ferromagnetism is imparted through thermal treatment or the like). One magnetic powder may be used alone or two or more magnetic powders may be used in combination.

In order to inhibit elution of metal ions (for example, iron ions) from the magnetic powder, surface treatment is preferably performed on the magnetic powder. In a situation in which metal ions elute on the surfaces of the toner cores during formation of the shell layers on the surfaces of the toner cores in an acidic condition, the toner cores tend to bond together. It is thought that the toner cores can be prevented from bonding together by inhibiting elution of the metal ions from the magnetic powder.

[Shell Layer]

In the toner having the above-described basic features, the shell layer covers the entirety of the surface of each toner core. The shell layer as above includes a unit substituted by a ring-unopened oxazoline group. The shell layer particularly preferably contains a polymer of monomers (resin raw materials) including the above-described compound (1) (for example 2-vinyl-2-oxazoline) and a (meth)acrylic acid alkyl ester (for example, methyl methacrylate). Coverage by the shell layer tends to increase by addition of the (meth)acrylic acid alkyl ester. The (meth)acrylic acid alkyl ester is particularly preferably substituted by an alkyl group having a carbon number of 1 or 2 at an ester moiety thereof.

[External Additive]

An external additive (specifically, a powder including a plurality of external additive particles) may be attached to the surfaces of the toner mother particles. Unlike internal additives, the external additive is selectively present on the surfaces of the toner mother particles (surface layers of the toner particles) and is not present inside the toner mother particles. The external additive particles can be attached to the surfaces of the toner mother particles for example by stirring the toner mother particles (powder) and the external additive (powder) together. The toner mother particles and the external additive particles bond together physically rather than chemically, without chemically reacting with each other. Bonding strength between each toner mother particle and the external additive particles can be adjusted by controlling stirring conditions (specific examples include stirring time and a rotational speed of stirring), a particle diameter, shape, and surface conditions of the external additive particles.

In order to make the external additive sufficiently exhibit its function while inhibiting detachment of the external additive particles from the toner particles, the amount of the external additive (in a configuration in which plural types of external additive particles are used, a total amount of the external additive particles is preferably at least 0.5 parts by mass and no greater than 10 parts by mass relative to 100 parts by mass of the toner mother particles.

The external additive particles are preferably inorganic particles, and particularly preferably silica particles or particles of a metal oxide (specific examples include alumina, titanium oxide, magnesium oxide, zinc oxide, strontium titanate, and barium titanate). However, particles of an organic acid compound such as a fatty acid metal salt (specific examples include zinc stearate) or resin particles may be used as the external additive particles. Also, composite particles formed from plural materials may be used as the external additive particles. The external additive particles may be subjected to surface treatment. One type of external additive particles may be used alone or two or more types of external additive particles may be used in combination.

EXAMPLES

The following describes examples of the present disclosure. Table 1 shows toners TA-1 to TA-7 and TB-1 to TB-5 (electrostatic latent image developing toners) according to the examples and comparative examples.

TABLE 1

| | Core | | Shell layer | |
|---|---|---|---|---|
| Toner | Releasing agent [g] | Resin [g] | Shell material [g] | Acetic acid [mg] |
| TA-1 | 350 | 0 | 8 | 0 |
| TA-2 | 550 | 0 | 7 | 0 |
| TA-3 | 350 | 0 | 8 | 2 |
| TA-4 | 350 | 0 | 11 | 0 |
| TA-5 | 550 | 0 | 10 | 0 |
| TA-6 | 350 | 0 | 10 | 1 |
| TA-7 | 350 | 100 | 8 | 0 |
| TB-1 | 600 | 0 | 6 | 0 |
| TB-2 | 350 | 0 | 7 | 0 |
| TB-3 | 550 | 0 | 12 | 0 |
| TB-4 | 300 | 0 | 8 | 10 |
| TB-5 | 350 | 300 | 8 | 0 |

The following describes production methods, evaluation methods, and evaluation results of the toners TA-1 to TA-7 and TB-1 to TB-5 in order. In evaluations in which errors may occur, an evaluation value was obtained by calculating an arithmetic mean of an appropriated number of measured values so that any error were sufficiently small.

[Method for Producing Toner]

(Preparation of Wax Dispersion)

Demineralised water, a high purity solid ester wax ("NISSAN ELECTOL (registered Japanese trademark) WEP-9" manufactured by NOF Corporation, acid value: 1.5 mgKOH/g) in an amount indicated in the column titled "Releasing agent" in Table 1, and 20 g of an anionic surfactant ("NEOGEN (registered Japanese trademark) SC" manufactured by DKS Co. Ltd., component: sodium dodecylbenzenesulfonate, active ingredient: 66% by mass) were mixed together. The resultant mixture was then emulsified through high pressure shearing using a Gaulin homogenizer ("APV (registered Japanese trademark)" manufactured by SPX Corporation). Through the above, 1,000 g of a wax dispersion was obtained. The demineralized water was added in such an amount by which a total mass of the demineralized water, the releasing agent (NISSAN ELECTOL WEP-9), and the anionic surfactant (NEOGEN SC) was 1,000 g. For example, in production of the toner TA-1, a mixture of 630 g of the demineralized water, 350 g of the releasing agent (NISSAN ELECTOL WEP-9) (see Table 1), and 20 g of the anionic surfactant "NEOGEN SC" was emulsified through high pressure shearing. In production of the toner TA-2, a mixture of 430 g of the demineralized water, 550 g of the releasing agent (NISSAN ELECTOL WEP-9) (see Table 1), and 20 g of the anionic surfactant (NEOGEN SC) was emulsified through high pressure shearing.

(Preparation of Resin Dispersion)

A 3-L reaction vessel equipped with a thermometer, a nitrogen inlet tube, a temperature adjusting device, a concentration device, and a stirrer (stirring impeller: three sweptback blades) was charged with 500 g of demineralized water and 10 g of an aqueous sodium dodecylbenzenesulfonate solution (aqueous solution of "NEOGEN SC" manufactured by DKS Co. Ltd.) having a solid concentration of 10% by mass. The temperature of the vessel contents was increased to 80° C. while the vessel contents were stirred. Then, a nitrogen gas was introduced into the vessel through the nitrogen inlet tube, and 300 g of styrene, 100 g of n-butyl acrylate, 10 g of an acrylic acid, 50 g of an aqueous hydrogen peroxide solution at a concentration of 10% by mass, and 50 g of an aqueous ascorbic acid solution at a concentration of 10% by mass were each dripped into the vessel at a constant rate over five hours in a nitrogen atmosphere at a temperature of 80° C.

The temperature of the vessel contents was then increased to 90° C. and the vessel contents were kept in the nitrogen atmosphere at the temperature of 90° C. for two hours to cause a reaction (specifically, a polymerization reaction) of the vessel contents. Thereafter, the vessel contents were cooled. Through the above, a resin dispersion having a mean volume diameter (MV) of 150 nm and a solid concentration of 20% by mass was obtained. The mean volume diameter was measured using a particle size distribution analyzer ("MICROTRAC (registered Japanese trademark) UPA" manufactured by MicrotracBEL Corp.). Resin particles contained in the resin dispersion contained a polymer of monomers including styrene, n-butyl acrylate, and the acrylic acid.

(Preparation of Toner Core Dispersion)

A 2-L reaction vessel equipped with an anchor type stirring impeller with a baffle plate was charged with 1,000 g of the wax dispersion prepared as above. 100 g of a colorant dispersion, and the resin dispersion (the resin dispersion prepared as above) in an amount indicated in the column titled "Resin" in Table 1. The colorant dispersion was an aqueous dispersion of a colorant ("EP-700 Blue GA" manufactured by Dainichiseika Color & Chemicals Mfg. Co., Ltd., component: copper phthalocyanine pigment (β), color index: Pigment Blue 15:3, solid concentration: 35% by mass). For example, in production of the toner TA-7, 1,000 g of the wax dispersion, 100 g of the colorant dispersion, and 100 g of the resin dispersion (see Table 1) were added. In production of the toner TB-5, 1,000 g of the wax dispersion, 100 g of the colorant dispersion, and 300 g of the resin dispersion (see Table 1) were added. In production of the other toners, the resin dispersion was not added. Note that the solid concentration of the resin dispersion was 20% by mass, and therefore, an amount of a resin added in production of the toner TA-7 was 20 g (=100×0.20). Also, the solid concentration of the colorant dispersion was 35% by mass, and therefore, an amount of the colorant added in production of each of the toners TA-1 to TA-7 and TB-1 to TB-5 was 35 g (=100×0.35).

Subsequently, 4 g of a coagulant (an aqueous aluminum sulfate solution) in terms of aluminum sulfate solid content was dripped into the vessel at a rate of 0.2 g/minute while the vessel contents were stirred. After the dripping of the coagulant was completed, the temperature of the vessel contents was increased to 50° C. at a rate of 1° C./minute while the vessel contents were stirred. Note that the temperature of the vessel contents was 30° C. at the start of the temperature increase. After the temperature increase was completed, the temperature of the vessel contents was kept at 50° C. to promote aggregation of particles within the vessel for granulation. Specifically, the temperature of the vessel contents was kept high (50° C.) until the volume median diameter ($D_{50}$) of aggregated particles reached 7 μm. Specifically, the temperature of the vessel contents was kept at 50° C. for approximately one hour.

Once the volume median diameter of the aggregated particles within the vessel reached 7 μm, 2 g of an aqueous sodium dodecylbenzenesulfonate solution (an aqueous solution of "NEOGEN SC" manufactured by DKS Co. Ltd.) at a solid concentration of 10% by mass was added into the vessel, and the temperature of the vessel contents was increased at a constant rate from 50° C. to 90° C. over 40 minutes and then kept at 90° C. for two hours. Thereafter, the vessel contents were cooled to 40° C. at a constant rate over 10 minutes. Subsequently, suction filtration of the vessel contents was performed using a Buchner funnel with filer paper having a pore size of 5 μm set therein. A solid (powder) obtained by the filtration (i.e., solid-liquid separation) of the vessel contents was washed with 5 L of ion exchanged water. Thereafter, a reslurry operation was performed by adding 1.6 L of ion exchanged water. Through the above, a toner core dispersion at a solid concentration of 20% by mass was obtained. A large number of toner cores were dispersed in the obtained toner core dispersion. The toner cores had compositions according to amounts of the added materials. For example, a mass ratio between core components (releasing agent/colorant) of the toner TA-1 was 10/1 (=350/35). That is, the toner cores of the toner TA-1 contained the releasing agent in an amount of 91% by mass (=100×10/11).

(Shell Layer Formation Process)

A 1-L three-necked flask equipped with a thermometer and a stirring impeller was set in a water bath and charged with 1,000 g of the toner core dispersion prepared as above. The temperature inside the flask was then kept at 40° C. using the water bath. Subsequently, a shell material in an amount indicated in Table 1 was added into the flask and the flask contents were stirred at a rotational speed of 200 rpm for one hour The shell material was an aqueous solution of oxazoline group-containing polymer ("EPOCROS WS-300" manufactured by Nippon Shokubai Co., Ltd., monomer composition: methyl methacrylate/2-vinyl-2-oxazoline, solid concentration: 10% by mass). For example, in production of the toner TA-1, 8 g of the shell material (EPOCROS WS-300) was added into the flask. In production of the toner TA-2, 7 g of the shell material (EPOCROS WS-300) was added into the flask.

Subsequently, 8 mL of an aqueous ammonia solution at a concentration of 1% by mass was added into the flask. The temperature inside the flask was then increased to 60° C. at a rate of 0.5° C./minute while the flask contents were stirred at a rotational speed of 150 rpm.

In production of each of the toners TA-3, TA-6, and TB-4, once the temperature inside the flask reached 60° C., an acetic acid at a concentration of 99% by mass and in an amount indicated in Table 1 was added into the flask at a constant rate. For example, in production of the toner TA-3, 2 g of the acetic acid at a concentration of 99% by mass was added into the flask. In production of the toner TA-6, 1 g of the acetic acid at a concentration of 99% by mass was added into the flask. Note that the acetic acid was not added in production of toners other than the toners TA-3, TA-6, and TB-4.

Subsequently, the temperature inside the flask was kept at 60° C. for 10 minutes while the flask contents were stirred at a rotational speed of 100 rpm. Then, the pH of the flask contents was adjusted to 7. An aqueous ammonia solution at a concentration of 1% by mass was used in the pH adjustment. Then, the flask contents were cooled to normal temperature (approximately 25° C.). Through the above, a dispersion containing a large number of toner mother particles was obtained.

(Washing Process)

The dispersion of the toner mother particles obtained as above was filtered (subjected to solid-liquid separation) using a Buchner funnel with filter paper having a pore size of 5 μm set therein to obtain a wet cake of the toner mother particles. Thereafter, the obtained wet cake of the toner mother particles was re-dispersed in ion exchanged water. Dispersion and filtration were further repeated five times to wash the toner mother particles. The toner mother particles were washed by repeating the dispersion and the filtration until the electrical conductivity of a filtrate (washing water) after the washing reached 1 μS/cm. The electrical conductivity was measured using an electrical conductivity meter "HORIBA ES-51" manufactured by HORIBA, Ltd.

(Drying Process)

Subsequently, the toner mother particles were dried using a continuous type surface modifier ("COATMIZER (registered Japanese trademark)" manufactured by Freund Corporation) under conditions of a hot air temperature of 45° C. and a flow rate of 2 $m^3$/minute. As a result, a powder of dry toner mother particles was obtained.

(External Additive Addition Process)

Subsequently, 1,000 g of the toner mother particles, 15 g of positively chargeable silica particles ("AEROSIL (registered Japanese trademark)" manufactured by Nippon Aerosil Co., Ltd., content: dry silica particles to which positive chargeability is imparted through surface treatment, number average primary particle diameter: approximately 20 nm), and 15 g of conductive titanium oxide particles ("EC-100" manufactured by Titan Kogyo, Ltd., base: $TiO_2$ particles, coat layer: Sb doped $SnO_2$ film) were mixed for five minutes using an FM mixer (product of Nippon Coke & Engineering Co., Ltd.). Through the above, external additives (the silica particles and the titanium oxide particles) were attached to surfaces of the toner mother particles. Thereafter, sifting was performed using a 200-mesh sieve (pore size: 75 μm). As a result, a toner (each of the toners TA-1 to TA-7 and TB-1 to TB-5) having a volume median diameter ($D_{50}$) of 7 μm was obtained.

Table 2 shows results of measurement of: a ring-unopened oxazoline group content: ΔH; a glass transition point; and toner temperatures at which a storage elastic modulus measured using a rheometer was respectively $10^8$ Pa and $10^5$ Pa, for samples (the toners TA-1 to TA-7 and TB-1 to TB-5).

TABLE 2

| Toner | Ring-unopened oxazoline group [μmol/g] | ΔH [mJ/mg] | Toner temperature [° C.] $10^8$ Pa | Toner temperature [° C.] $10^5$ Pa | Tg [° C.] |
|---|---|---|---|---|---|
| TA-1 | 563 | 81 | 72 | 82 | 67 |
| TA-2 | 503 | 155 | 71 | 82 | 66 |
| TA-3 | 502 | 81 | 72 | 82 | 69 |
| TA-4 | 1,400 | 81 | 75 | 84 | 69 |
| TA-5 | 1,194 | 156 | 75 | 83 | 68 |
| TA-6 | 1,138 | 81 | 75 | 84 | 69 |
| TA-7 | 556 | 80 | 71 | 81 | 65 |

TABLE 2-continued

| Toner | Ring-unopened oxazoline group [μmol/g] | ΔH [mJ/mg] | Toner temperature [° C.] $10^8$ Pa | Toner temperature [° C.] $10^5$ Pa | Tg [° C.] |
|---|---|---|---|---|---|
| TB-1 | 452 | 172 | 69 | 82 | 63 |
| TB-2 | 493 | 81 | 68 | 82 | 65 |
| TB-3 | 1,520 | 153 | 78 | 89 | 74 |
| TB-4 | 432 | 74 | 76 | 86 | 71 |
| TB-5 | 566 | 79 | 65 | 80 | 63 |

For example, the toner TA-1 had: a ring-unopened oxazoline group content (specifically, an amount of the ring-unopened oxazoline group contained in 1 g of the toner) of 563 μmol; ΔH (specifically, an amount of endothermic energy generated due to melting of the releasing agent contained in 1 mg of the toner) of 81 mJ; a temperature of 72° C. at which the storage elastic modulus was $10^8$ Pa; a temperature of 82° C. at which the storage elastic modulus was $10^5$ Pa; and a glass transition point (Tg) of 67° C. The above properties were measured by the following methods.

<Method for Measuring Ring-Unopened Oxazoline Group Content>

The ring-unopened oxazoline group content was measured by gas chromatography-mass spectrometry (GC/MS method). In the GC/MS method, a gas chromatograph mass spectrometer ("GCMS-QP2010 Ultra" manufactured by Shimadzu Corporation) and a multi-shot pyrolyzer ("FRONTIER LAB MULTI-FUNCTIONAL PYROLYZER (registered Japanese trademark) PY-3030D" manufactured by Frontier Laboratories Ltd.) were used as measuring devices. A GC column ("AGILENT (registered Japanese trademark) J&W Ultra-inert Capillary GC Column DB-5 ms" manufactured by Agilent Technologies Japan, Ltd., phase: allylene phase having a polymer main chain strengthened by introducing allylene to siloxane polymer, inner diameter: 0.25 mm, film thickness: 0.25 μm, length: 30 m) was used as a column.

(Gas Chromatograph)

Carrier gas: Helium (He) gas

Carrier flow rate: 1 mL/minute

Vaporizing chamber temperature: 210° C.

Thermal decomposition temperature: 600° C. in heating furnace, 320° C. at interface portion Temperature increase conditions: Kept at 40° C. for three minutes, increased from 40° C. to 300° C. at a rate of 10° C./minute, and then kept at 300° C. for 15 minutes.

(Mass Spectrometry)

Ionization method: Electron impact (EI) method

Ion source temperature: 200° C.

Temperature at interface portion: 320° C.

Detection mode: Scan (measurement range: from 45 m/z to 500 m/z)

An amount of the ring-unopened oxazoline group contained in a measurement target (toner) (i.e., an amount of the ring-unopened oxazoline group contained in 1 g of the toner) was determined based on a peak area of a measured chromatogram by identifying a peak unique to the ring-unopened oxazoline group through analysis of a mass spectrum measured under the above conditions. A calibration curve was used for the determination.

<Method for Measuring Toner Temperatures at which Storage Elastic Modulus is $10^8$ Pa and $10^5$ Pa>

First, 0.1 g of a toner (measurement target: any of the toners: TA-1 to TA-7 and TB-1 to TB-5) was set in a pelleting machine and a pressure of 5 MPa was applied to the toner, whereby a cylindrical pellet having a diameter of 10 mm and a thickness of 1.2 mm was obtained. The obtained pellet was set in a measuring device. A rheometer ("PhysicaMCR-301" manufactured by Anton Paar Japan K.K.) was used as the measuring device. A measurement jig (a parallel plate) was attached to a tip end of a shaft of the measuring device (specifically, a shaft driven by a motor). The pellet was placed on a plate of the measuring device (specifically, a heater board heated by a heater). The pellet on the plate was heated to 110° C. to once melt the pellet (a block of the toner). When the toner was completely melted, the measurement jig (the parallel plate) was brought into close contact with the melted toner from above to interpose the toner between two parallel plates (upper plate: the measurement jig, lower plate: the heater board). Then, the toner was cooled to 40° C. Thereafter, a G' temperature dependence curve (vertical axis: storage elastic modulus, horizontal axis: temperature) of the toner was plotted using the measuring device under conditions of a measurement temperature range of from 40° C. to 200° C., a heating rate of 4° C./minute, an oscillation frequency of 1 Hz, and a strain of 1% (with the proviso that the strain ranged from 0.01% to 1% within a measurement temperature range of from 40° C. to 100° C.). A temperature at which the storage elastic modulus was $10^8$ Pa and a temperature at which the storage elastic modulus was $10^5$ Pa were read from the plotted temperature dependence curve of the storage elastic modulus.

<Method for Measuring ΔH and Tg>

A differential scanning calorimeter ("DSC-6220" manufactured by Seiko Instruments Inc.) was used as a measuring device. The glass transition point (Tg) of the toner (measurement target: any of the toners TA-1 to TA-7 and TB-1 to TB-5) was determined by plotting a heat absorption curve of the toner using the measuring device. Specifically, 10 mg of the toner was placed in an aluminum pan (an aluminum container) and the aluminum pan was set in a measurement section of the measuring device. An empty aluminum pan was used as a reference. In the plotting of the heat absorption curve, the temperature of the measurement section was increased from a measurement start temperature of −20° C. to 150° C. at a rate of 10° C./minute (RUN 1). Thereafter, the temperature of the measurement section was decreased from 150° C. to −20° C. at a rate of 10° C./minute. Subsequently, the temperature of the measurement section was increased again from −20° C. to 150° C. at a rate of 10° C./minute (RUN 2). The heat absorption curve (vertical axis: heat flow (DSC signal), horizontal axis: temperature) of the sample was plotted in RUN 2. Tg and ΔH of the toner were read from the plotted heat absorption curve. On the heat absorption curve, a temperature (an onset temperature) at a point of inflection (an intersection point between an extrapolation of a base line and an extrapolation of an inclined portion of the curve) caused due to glass transition corresponds to the glass transition point (Tg) of the toner. Also, the amount (ΔH) of endothermic energy generated due to melting of the releasing agent contained in 1 mg of the toner was determined from an area of a heat absorption peak.

[Evaluation Methods]

Each sample (each of the toners TA-1 to TA-7 and TB-1 to TB-5) was evaluated by the following methods.

(Heat-Resistant Preservability)

First, 3 g of a toner (measurement target: any of the toners TA-1 to TA-7 and TB-1 to TB-5) was placed in a 20-mL polyethylene container and the container was left to stand for three hours within a thermostatic chamber set at 60° C.

Thereafter, the toner was taken out of the thermostatic chamber and cooled at 20° C. for three hours to obtain an evaluation toner.

The obtained evaluation toner was placed on a 100-mesh sieve (opening: 150 μm). A mass of the sieve including the evaluation toner placed thereon was measured to determine a mass of the toner on the sieve (a mass of the toner before sifting). Subsequently, the sieve was set in a powder property evaluation machine ("POWDER TESTER (registered Japanese trademark)" manufactured by Hosokawa Micron Corporation) and shaken for 30 seconds at a rheostat level of 5 in accordance with a manual of POWDER TESTER to sift the evaluation toner. After the sifting, a mass of the sieve including toner remaining thereon was measured to determine a mass of the toner remaining on the sieve (a mass of the toner after the sifting). An aggregation rate (unit: % by mass) was calculated by the following equation from the mass of the toner before the sifting and the mass of the toner after the sifting.

$$\text{Aggregation rate}=100\times(\text{mass of toner after sifting})/(\text{mass of toner before sifting})$$

An aggregation rate smaller than 10% by mass was evaluated as "good", and an aggregation rate equal to or larger than 10% by mass was evaluated as "poor".

(Preparation of Evaluation Developer)

An evaluation developer (a two-component developer) was prepared by mixing 100 parts by mass of a developer carrier (carrier for "TASKalfa5550ci" manufactured by KYOCERA Document Solutions Inc.) and 10 parts by mass of a toner (evaluation target: any of the toners TA-1 to TA-7 and TB-1 to TB-5) for 30 minutes using a ball mill in an environment at a temperature of 23° C. and a relative humidity of 50%.

(Lowest Fixing Temperature)

Lowest fixing temperature was evaluated by forming an image using the evaluation developer (the two-component developer) prepared as above. A printer ("FS-C5250DN" manufactured by KYOCERA Document Solutions Inc. and modified to enable adjustment of a fixing temperature) including a Roller-Roller type heat and pressure fixing device was used as an evaluation apparatus. The evaluation developer was loaded into a developing device of the evaluation apparatus and a toner (evaluation target: any of the toners TA-1 to TA-7 and TB-1 to TB-5) was loaded into a toner container of the evaluation apparatus.

A solid image (specifically, an unfixed toner image) was formed on paper (A4 size printing paper) having a basis weight of 90 g/m$^2$ using the evaluation apparatus under conditions of a linear velocity of 200 min/second and a toner application amount of 1.0 mg/cm$^2$ in an environment at a temperature of 23° C. and a relative humidity of 50%. The paper with the image formed thereon was then passed through the fixing device of the evaluation apparatus.

In evaluation of the lowest fixing temperature, the fixing temperature was set within a range of from 90° C. to 120° C. Specifically, the fixing temperature of the fixing device was increased from 90° C. in increments of 2° C. to determine a lowest temperature (the lowest fixing temperature) at which the solid image (the toner image) was fixable to the paper. Whether or not the toner was fixable was confirmed by a fold-rubbing test as described below.

The evaluation paper having passed through the fixing device was folded such that a surface on which the image had been formed was folded inwards, and then a 1-kg weight covered with cloth was rubbed back and forth on the fold five times. Then, the paper was unfolded and a folded portion of the paper (a portion on which the solid image had been formed) was observed. A length of peeling of the toner (a peeling length) in the folded portion was measured. A lowest temperature among fixing temperatures for which the peeling length was no longer than 1 mm was determined to be the lowest fixing temperature. A lowest fixing temperature of no higher than 100° C. was evaluated as "good" and a lowest fixing temperature of higher than 100° C. was evaluated as "poor".

[Evaluation Results]

Results of evaluation of heat-resistant preservability (the aggregation rate) and low-temperature fixability (the lowest fixing temperature) for each of the toners TA-1 to TA-7 and TB-1 to TB-5 are shown in Table 3.

TABLE 3

| | Toner | Heat-resistant preservability [% by mass] | Lowest fixing temperature [° C.] |
|---|---|---|---|
| Example 1 | TA-1 | 2 | 92 |
| Example 2 | TA-2 | 2 | 92 |
| Example 3 | TA-3 | 2 | 92 |
| Example 4 | TA-4 | 1 | 100 |
| Example 5 | TA-5 | 1 | 98 |
| Example 6 | TA-6 | 1 | 100 |
| Example 7 | TA-7 | 9 | 98 |
| Comparative example 1 | TB-1 | 16 | 90 |
| Comparative example 2 | TB-2 | 20 | 90 |
| Comparative example 3 | TB-3 | 1 | 110 |
| Comparative example 4 | TB-4 | 1 | 106 |
| Comparative example 5 | TB-5 | 44 | 88 |

The toners TA-1 to TA-7 (toners according to Examples 1 to 7 each had the above-described basic features. Specifically, toner particles of each of the toners TA-1 to TA-7 each included a toner core and a shell layer. The toner core contained a releasing agent substituted by a carboxyl group. The shell layer covered the entirety of a surface of the toner core. The shell layer included a unit substituted by a ring-unopened oxazoline group. A ring-unopened oxazoline group content of the toner (specifically, an amount of the ring-unopened oxazoline group contained in 1 g of the toner as measured by gas chromatography-mass spectrometry) was at least 500 μmol and no greater than 1,400 μmol (see Table 2). ΔH of the toner (specifically, an amount of endothermic energy generated due to melting of the releasing agent contained in 1 mg of the toner as measured by differential scanning calorimetry) was at least 80 mJ and no greater than 160 mJ (see Table 2).

The toners TA-1 to TA-7 were each excellent in low-temperature fixability as indicated in Table 3. The toners TA-1 to TA-7 each exhibited sharp meltability. The toners TA-1 to TA-7 were each excellent in heat-resistant preservability as indicated in Table 3. Detachment of the releasing agent from the toner particles was sufficiently inhibited in each of the toners TA-1 to TA-7.

What is claimed is:

1. An electrostatic latent image developing toner comprising a plurality of toner particles each including a core and a shell layer, wherein the core contains a releasing agent substituted by a carboxyl group, the shell layer covers the entirety of a surface of the core, the shell layer includes a unit substituted by a ring-unopened oxazoline group, an amount of the ring-unopened oxazoline group contained in 1 g of the toner as measured by gas chromatography-mass spectrometry is at least 500 μmol and no greater than 1,400 μmol, and an amount of endothermic energy generated due to melting of the releasing agent contained in 1 mg of the toner as measured by differential scanning calorimetry is at least 80 mJ and no greater than 160 mJ.

2. The electrostatic latent image developing toner according to claim 1, wherein the core contains the releasing agent in an amount of at least 60% by mass and no greater than 95% by mass.

3. The electrostatic latent image developing toner according to claim 2, wherein the core further contains a colorant, and the core does not contain a binder resin or contains a binder resin in an amount of no greater than 15% by mass.

4. The electrostatic latent image developing toner according to claim 3, wherein the core has no oxazoline group, the core contains no crystalline polyester resin, the releasing agent substituted by the carboxyl group is an ester wax, and the core is a polymerized core.

5. The electrostatic latent image developing toner according to claim 1, wherein the toner has a storage elastic modulus of $1.0\times10^8$ Pa at a temperature equal to or higher than 70° C., and the toner has a storage elastic modulus of $1.0\times10^5$ Pa at a temperature equal to or lower than 85° C.

6. The electrostatic latent image developing toner according to claim 5, wherein the toner has a glass transition point of at least 65° C. and no higher than 70° C.

7. The electrostatic latent image developing toner according to claim 1, wherein the shell layer includes a unit represented by a formula (A shown below, (A)

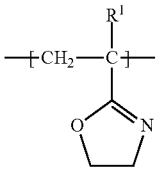

where in the formula (A), $R^1$ represents a hydrogen atom or an alkyl group optionally substituted by a substituent.

8. The electrostatic latent image developing toner according to claim 7, wherein the shell layer further includes a unit represented by a formula (B) shown below, (B)

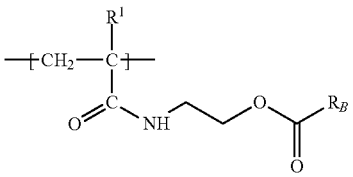

where in the formula (B), $R^1$ represents the same as $R^1$ in the formula (A) and $R_D$ represents the releasing agent contained in the core.

9. The electrostatic latent image developing toner according to claim 8, wherein the shell layer further includes a unit represented by a formula (C) shown below, (C)

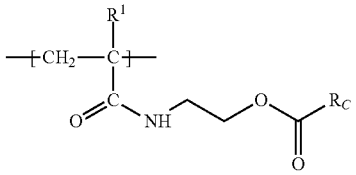

where in the formula (C), $R^1$ represents the same as $R^1$ in the formula (A) and $R_C$ represents an alkyl group optionally substituted by a substituent.

10. The electrostatic latent image developing toner according to claim 8, wherein the core contains a polymer of monomers including a styrene-based monomer, a (meth)acrylic acid alkyl ester, and a (meth)acrylic acid, and the shell layer further includes a unit represented by a formula (D) shown below, (D)

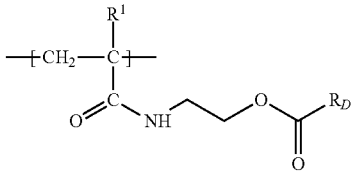

where in the formula (D), $R^1$ represents the same as $R^1$ in the formula (A) and $R_D$ represents the polymer contained in the core.

11. The electrostatic latent image developing toner according to claim 1, wherein the shell layer contains a polymer of monomers including a compound represented by a formula (1) shown below and a (meth)acrylic acid alkyl ester, (1)

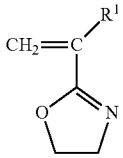

where in the formula (1), $R^1$ represents a hydrogen atom or an alkyl group optionally substituted by a substituent.

* * * * *